United States Patent [19]

Patton, Sr. et al.

[11] Patent Number: 4,776,180

[45] Date of Patent: Oct. 11, 1988

[54] UPDRAFT INTEGRATED HEAT PUMP

[75] Inventors: James M. Patton, Sr., Gulfport, Miss.; Andrew L. Blackshaw, Dunwoody; Matthew S. Reid, Atlanta; Ray E. Channell, Decatur; James T. Hogan, Roswell; Jerry O. McGuffey, Stone Mountain, all of Ga.

[73] Assignee: Mississippi Power Company, Gulfport, Miss.

[21] Appl. No.: 865,752

[22] Filed: May 22, 1986

[51] Int. Cl.[4] ..... F25B 27/00

[52] U.S. Cl. ..... 62/238.6; 62/238.7; 62/324.1; 237/2 B

[58] Field of Search ..... 62/238.6, 238.7, 324.1; 237/2 B; 165/54

[56] References Cited

U.S. PATENT DOCUMENTS

| | | | |
|---|---|---|---|
| 3,017,162 | 1/1962 | Haines et al. | 62/238.6 X |
| 3,513,663 | 5/1970 | Martin, Jr. et al. | 62/238.6 X |
| 4,420,034 | 12/1983 | Vandervart | 62/238.7 X |
| 4,441,546 | 4/1984 | Vandervart | 62/238.7 X |
| 4,505,328 | 3/1985 | Schmitt | 237/2 B X |

*Primary Examiner*—Lloyd L. King

*Attorney, Agent, or Firm*—B. J. Powell

[57] ABSTRACT

This invention relates to an integrated heat pump construction including a housing having mounted thereon a first air-to-refrigerant heat exchanger coil assembly, a blower assembly, a compressor, a second refrigerant-to-liquid heat exchange coil assembly and, a third refrigerant-to-potable liquid heat exchange coil assembly, wherein said compressor and said first, second and third heat exchange coil assemblies are connected together to form a heat pump circuit with potable liquid heating capacity.

17 Claims, 4 Drawing Sheets

UPDRAFT INTEGRATED HEAT PUMP

BACKGROUND OF THE INVENTION

This invention relates generally to heat pumps and more particularly to a heat pump with potable water heating capability.

In the past, heat pump systems have typically been split systems with an outdoor unit containing the compressor, heat exchange coil and a fan and an indoor unit including an air circulation blower and a heat exchange coil. More recently, potable water heat exchange coils have been added to the heat pump system so that domestic hot water can also be heated. Still more recently, the outdoor refrigerant-to-air heat exchange coils have sometimes been replaced by a refrigerant-to-liquid heat exchange coil so that an external liquid could be used as a source to heat or cool for this heat exchange coil. Typically, this source of heating/cooling is ground water or a ground loop water circuit.

With the advent of non-air heat exchange coils to replace the normal outdoor coil, there is no necessity that any of the components of the system be located outside. Some attempts have been made to incorporate the refrigerant-to-liquid heat exchange coils and the compressor in a single cabinet housing the indoor unit. One of the problems associated with these attempts is that the size of the resulting unit is larger than the original indoor unit so that, in retrofit applications, the ductwork had to be modified in order to incorporate these units. Further, in updraft situations where the unit is housed in small utility closets with the return air duct in the floor and the supply air duct in the ceiling, the prior art simply has not been able to provide a retrofit unit without significantly modifying the ductwork associated with the utility closet.

SUMMARY OF THE INVENTION

These and other problems and disadvantages associated with the prior art are overcome by the invention disclosed herein by providing a heat pump system which has all of the components thereof housed in a single housing and which has a small enough size to be substituted for existing indoor units, especially in updraft applications, without modifying existing ductwork. The invention has domestic hot water heating capability as well as the capability of using an external liquid source as a heat sink and a cooling source such as ground water or a ground loop.

The apparatus of the invention includes generally a housing which defines an air passage throughout the length of the housing with the air passage opening onto opposite ends of the housing. An air-to-refrigerant heat exchange coil assembly is mounted in the air passage in the housing to divide the air passage into first and second sections. Typically, the housing is oriented so that the air passage is vertical so that it can be used in an updraft application. A blower is mounted in the housing above the air coil to draw air through the passage and the air coil. A compressor is mounted in the housing below the air coil on one side of the air passage. A ground loop water coil is mounted in the air passage below the air coil adjacent the side of the passage. A potable water coil is mounted in the air passage below the air coil and projects up into a space behind the air coil. An air filter is located at the bottom of the housing below the compressor so that air drawn in through the bottom of the housing will pass between the compressor and water coils up through the air coil and through the blower out of the housing.

These and other features and advantages of the invention will become more clearly understood upon consideration of the following detailed description and accompanying drawings wherein like characters of reference designate corresponding parts throughout the several views and in which:

Figure 1:
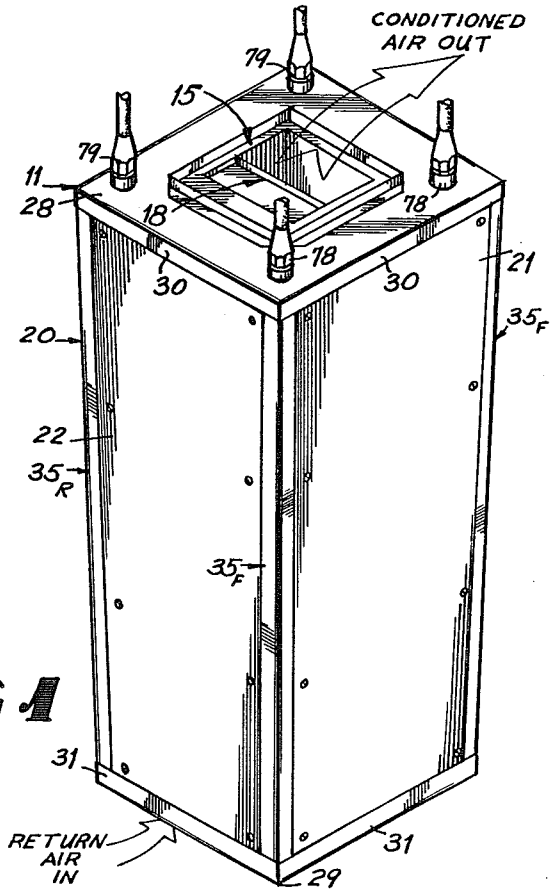
FIG. 1 is a perspective view of the invention.

These figures and the following detailed description disclose specific embodiments of the invention, however, the inventive concept is not limited thereto since it may be embodied in other forms.

DETAILED DESCRIPTION OF ILLUSTRATIVE EMBODIMENTS

Referring to the figures, it will be seen that the invention is incorporated in a heat pump system 10, the particular embodiment illustrated being designed for a counterflow application where the return air passes into the bottom of the heat pump system and the conditioned air passes out of the top of the heat pump system. It will be appreciated that other orientations may be used to achieve different flow patterns.

The heat pump system 10 includes generally an upright housing 11 which defines longitudinally extending air passage 12 therethrough with an inlet 14 at the bottom of the housing 11 and an outlet 15 at the top of the housing 11. Mounted in the lower portion of the housing 11 within the air passage 12 is a heat pump circuit 16 and mounted in the air passage 12 above the heat pump circuit 16 is an air blower 18 which draws air into the passage 12 through the inlet 14 at the bottom thereof and forces the air through the passage 12 and out the inlet 15 while the heat pump circuit 16 conditions the air as will become more apparent. Positioned below the heat pump circuit 16 at the inlet 14 is an air filter 19 to filter the air coming into the air passage 12.

The housing 11 includes an upstanding open frame 20 defining front, rear and side openings therethrough, defining the outlet 15 in the upper end thereof and defining the inlet 14 in the bottom thereof. A front panel 21 closes the front opening in the frame 20 while side panels 22 close the side openings therein and rear panel 24 closes the rear opening therein to define the air passage 12 therethrough.

The frame 20 includes a top plate 28 and a bottom plate 29 having like sizes and a rectilinear shape. The top plate 28 defines depending flanges 30 around the periphery thereof while the bottom plate 29 defines upstanding flanges 31 around the four peripheral edges thereof. The bottom plate 29 defines the inlet opening 14 therethrough. The inlet opening 14 is smaller than the size of the air filter 19 so as to support the air filter 19 on top of the plate 29. Locating flanges 32 are provided on the top of the bottom plate 29 around the inlet opening 14 to locate the air filter 19 laterally of the inlet opening 14.

Four upstanding corner members 35 connect the four corners of the top and bottom plates 28 and 29 to form the open frame 20. Each of the corner members 35 is formed with right angle flanges 36 joined at the corner of the members and with the projecting edges of the flanges 36 provided with offset flanges 38 to locate the panels 21, 22 and 24 between the corner members 35. Thus, it will be seen that the front opening in the frame 20 is defined between the front corner members $35_F$, the rear opening is defined between the rear corner members $35_R$, while the side openings are defined between each set of front and rear corner members 35.

Mounted between the front corner members $35_F$ is a front cross member 39 with a generally U-shaped cross-sectional configuration. The front cross member 39 is spaced a prescribed distance above the bottom plate 29 and is oriented parallel to the bottom plate 29. A rear cross member 40 is mounted between the rear corner members 35 at the same height from the bottom plate 29 as the front cross member 39. The rear cross member 40 is also parallel to the bottom plate 29 and has an L-shaped cross-section. The front and rear cross members 39 and 40 each have a flange which projects into the interior of the frame 20 as will become more apparent.

The front cross member 39 removably mounts a filter retainer 41 thereon which serves to retain the air filter 19 over the inlet opening 14 through the bottom plate 29. It will also be noted that the offset flanges 38 on the bottom of the front corner members $35_F$ are notched out so that the air filter 19 can pass therethrough to be removed when the filter retainer 41 is removed from the front cross member 39.

A plurality of component mounting members 42 are mounted between the front and rear cross members 39 and 40 and serve to mount the components of the heat pump circuit thereon as will become more apparent. The component mounting members 42 include a first pair of compressor mounting members $42_C$ which extend between the cross members 39 and 40 adjacent one of the side openings in the frame 20. An accummulator mounting member $42_A$ extends between the cross members 39 and 40 adjacent the opposite side opening in the frame 20. For sake of clarity, the mounting members $42_C$ are mounted adjacent the left side opening as viewed in FIG. 2 while the mounting member $42_A$ is mounted adjacent the right side opening as seen in FIG. 2.

Figure 5:
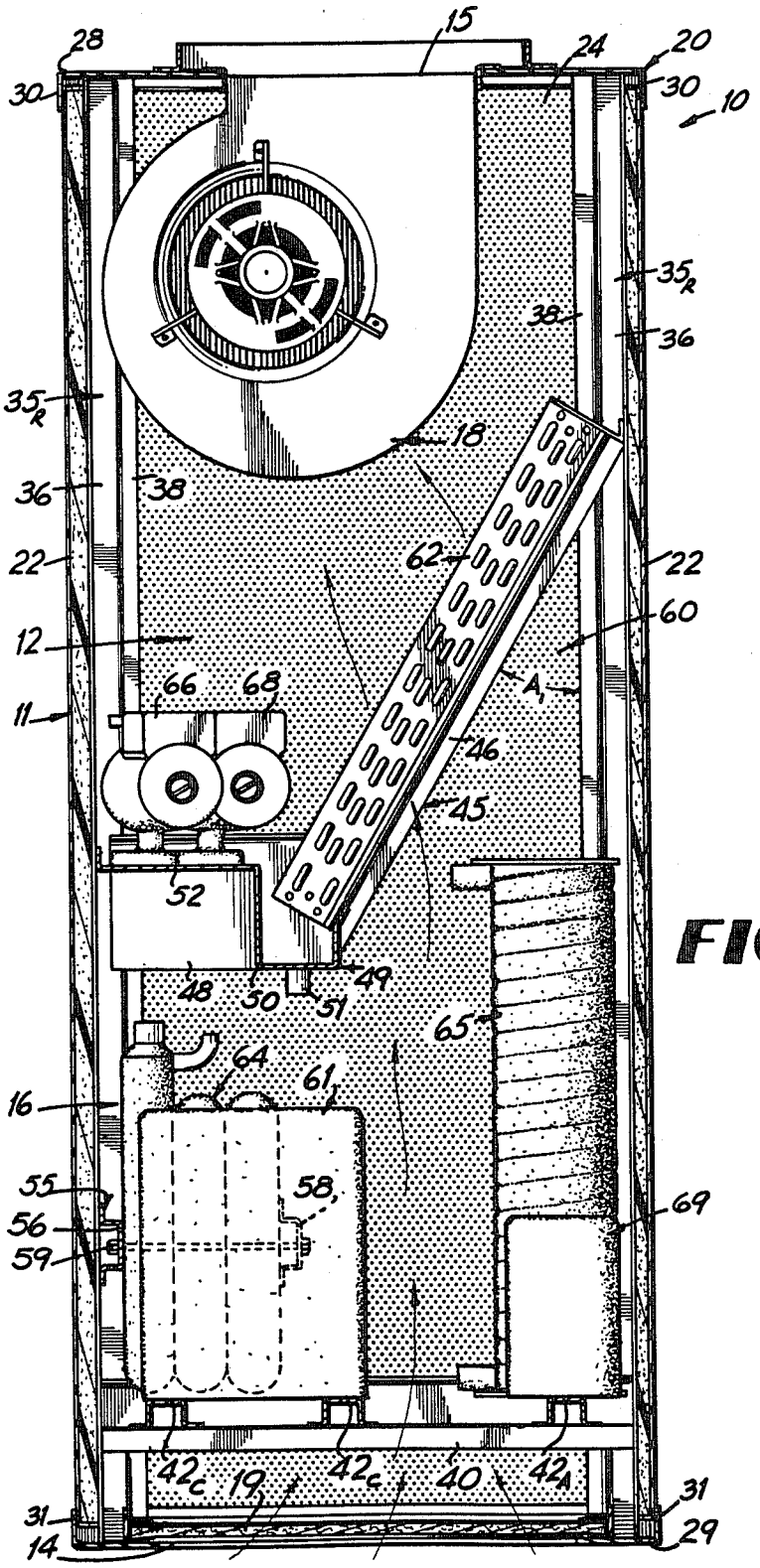
FIG. 5 is a cross-sectional view taken generally along Line 5—5 in FIG. 4.

An air coil subframe 45 is mounted between the corner members 35 intermediate the ends thereof. The subframe 45 includes a pair of spaced apart side members 46 mounted on the front and rear corner members $35_F$ and $35_R$ on the right side of the housing as seen in FIG. 2 which angle downwardly therefrom at an included angle $A_1$ (illustrated at about 30°) with respect to the corner members 35. The side members 46 are connected to the side plates 48 at the lower end thereof which extend from the side members 46 to the corner members 35 on the left side of the housing as seen in FIG. 2. The side plates 48 are connected by a condensate catch pan 49 best seen in FIG. 5 which has a generally U-shaped section 50 in alignment with the lower end of the side members 46 as will become more apparent so that the section 50 will collect the condensate therein. A drain pipe 51 is provided to discharge the condensate from the section 50. Integral with the upper edge of the U-shaped section 50 and extending therefrom toward the posts 35 on the left side of the housing (seen in FIG. 2) is a generally horizontally oriented mounting plate 52 (FIG. 5) which is provided with an upstanding reinforcing and mounting lip 54 at that edge opposite the section 50.

Air coil subframe 45 is mounted at a convenient height in the frame 20 so that the subframe 45 is located above the heat pump circuit 16 with piping clearance and is also located below the blower 18 to provide air flow clearance. It will thus be seen that the subframe 45 thus divides the air passage 12 into two sections.

Figure 2:
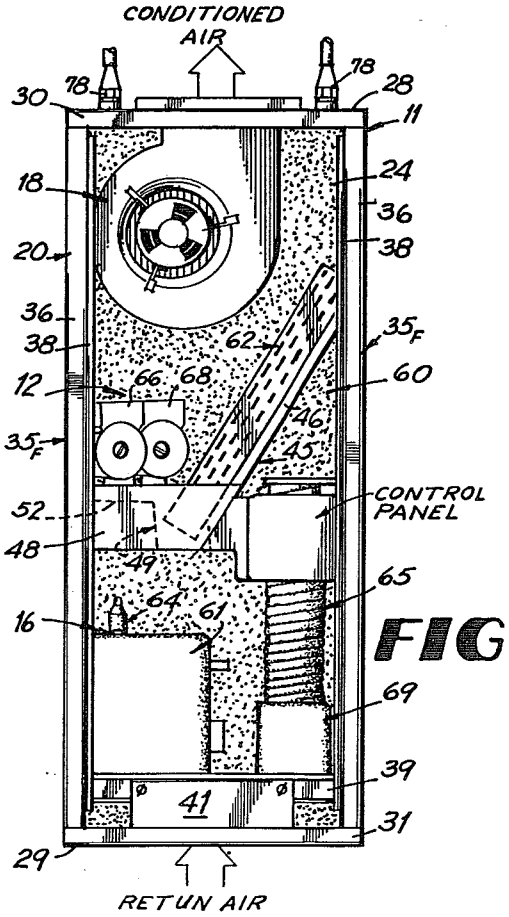
FIG. 2 is a front elevational view with the front cover removed.
Figure 3:
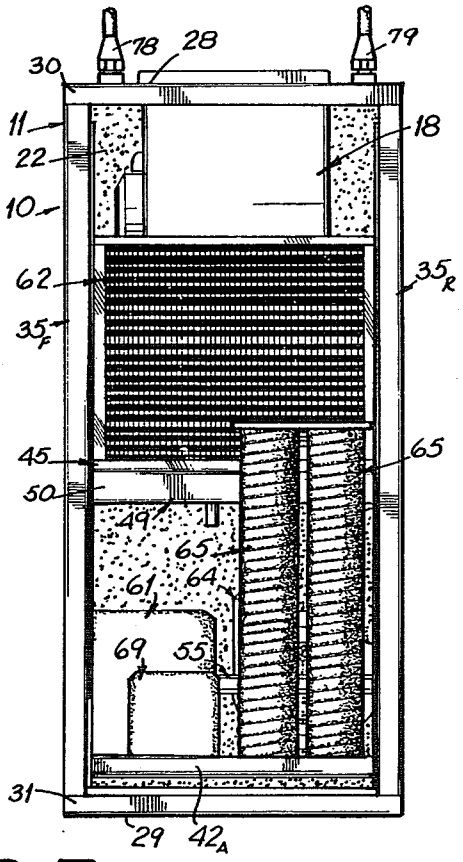
FIG. 3 is a right side view with the cover removed.
Figure 4:
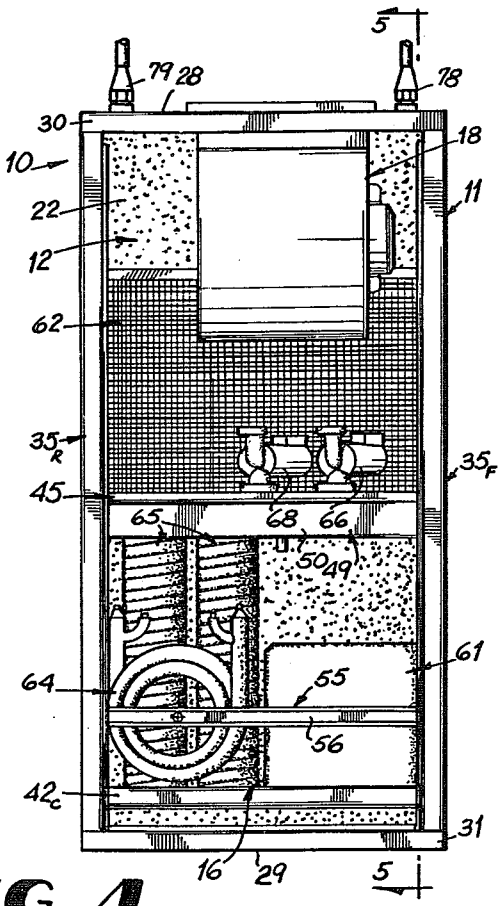
FIG. 4 is a left side view with the cover removed.

A water coil mounting assembly 55 is mounted between the front and rear corner members 35 on the left side of frame 20 when viewed in FIG. 2. FIG. 4 best illustrates the assembly 55. Assembly 55 includes a base member 56 connected between the corner members 35, oriented parallel to bottom plate 29 and spaced a prescribed distance thereabove. A shorter clamping member 58 is connected to the base member 56 by a fastener 59.

Figure 6:
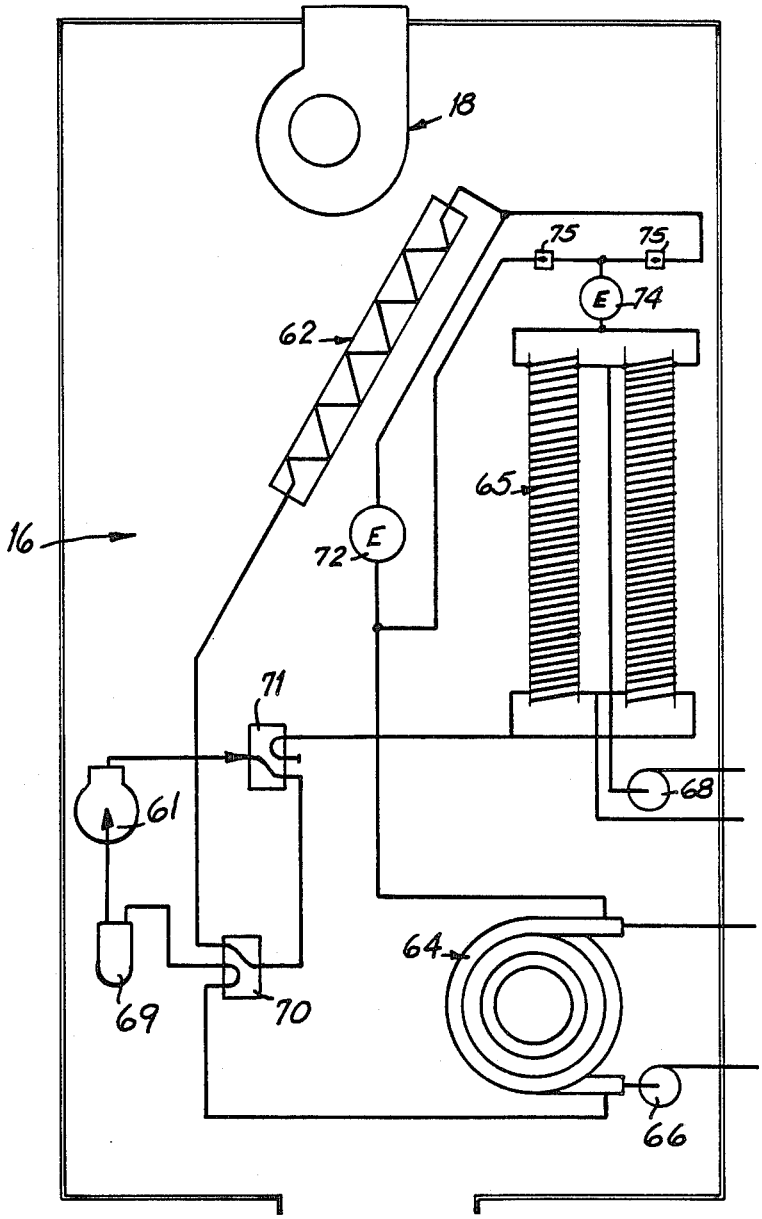
FIG. 6 is a schematic drawing for the heat pump system incorporating the invention.

The heat pump circuit 16 will best be understood by reference to FIG. 6 which schematically shows the components thereof. Basically, the heat pump circuit 16 includes a compressor 61 selectively connected to a space heat exchanger 62, a source heat exchanger 64 and an alternate heat exchanger 65 through a four-way reversing valve 70 and a three-way valve 71. The operation of this heat pump circuit is disclosed in application Ser. No. 827,733 owned by the same assignee and incorporated herein by reference. The space heat exchanger 62 is mounted on the side members 46 of the air coil subframe 45 and is a refrigerant-to-air coil so that air passing through the air passage 12 will pass through the space heat exchanger 62 to be heated or cooled. The source heat exchanger 64 is illustrated as a conventional concentric tube coil and is mounted on the coil mounting assembly 55 where it is clamped between the base member 56 extending between the front and rear corner members 35 on the left side of the machine as seen in FIG. 2 and held in place by the clamping member 58 and fastener 59.

The compressor 61 is cushion mounted on the component mounting members $42_C$ so that it is located beside the source heat exchanger 64 and also located in one side of the air passage 12.

The alternate heat exchanger 65 is illustrated as a refrigerant-to-liquid double wound tube coils such as that disclosed in U.S. Pat. No. 4,316,502 with a refrigerant and liquid coil wound together to provide a double tube wall between the liquid and refrigerant. The alternate heat exchanger 65 is set up to heat domestic hot water. The alternate heat exchanger 65 includes two of the double wound coils which are mounted on the mounting member $42_A$ along the right side of the housing as seen in FIG. 2. The height of the alternate heat exchanger 65 is such that the exchanger extends above the lower level of the space heat exchanger 62 and the frame 45 into the tapering space 60 defined below the sloping heat exchanger 62 and the right side of the housing 11.

It will also be appreciated that a source liquid pump 66 is provided for pumping the source liquid to the source heat exchanger 64. The source liquid pump 66 is typically connected to a ground loop or a source of ground water so that the source liquid can be circulated through the source heat exchanger 64. The source liquid pump 66 is mounted on the mounting plate 52 on the air coil subframe 45 and is located above the mounting plate 52.

A potable liquid pump 68 is also provided for pumping hot water from an external hot water tank (not shown) through the alternate heat exchanger 65. The potable liquid pump 68 is also mounted on the mounting plate 52 on the top thereof. This allows the pipes from the pumps 66 and 68 to pass down through the mounting plate 52 into the lower portion of the air passage 12 to be connected to the appropriate heat exchangers while the other side of the pumps may be piped through the top of the housing 11 as illustrated in the drawings to provide for the inlets $I_S$ and $I_P$ and outlets $O_S$ and $O_P$ for the source liquid and the potable liquid.

A suction accummulator 69 is also mounted on the mounting member $42_A$ in a side-by-side relationship with the coils of the alternate heat exchanger 65 so that the central portion of the air passage 12 is left open for the passage of air therethrough after it passes through the filter 19. Thus, the air flows up through the lower portion of the air passage 12 which houses the heat pump circuit, through the space heat exchanger 62 and finally out through the blower 18 to be returned to the conditioned space.

One side of the space heat exchanger 62, the source heat exchanger 64, and the alternate heat exchanger 65 is connected to the high pressure outlet and suction inlet of the compressor 61 by the valves 70 and 71. The other side of the source heat exchanger 64 and the space heat exchanger 62 are connected together through conventional expansion device 72. The other side of the alternate heat exchanger 65 is connected to an alternate expansion device 74 whose outlet is in turn connected in parallel across the expansion device 72 through check valves 75 as set forth in application Ser. No. 827,733.

The source heat exchanger 64 and pump 66 are connected to the external ground loop or liquid source through the fittings 78 in the top of housing 11. If the ground loop or liquid source is already under flowing pressure then the pump 66 can be replaced with a flow control valve. The alternate heat exchanger 65 and its pump 68 are connected to an external hot water circuit through the fittings 79 in the top of housing 11. If the external hot water circuit has its own flow generating components, the pump 68 can be eliminated or replaced with a flow control device.

It will thus be seen that the air entering the housing 11 flows around the compressor 61, ground loop coil 64, potable water coils 65, accummulator 69 as it passes to the heat exchanger 62. In other words, there is no dedicated air flow path in the lower position of air passage 12. The components of the heat pump circuit 16 are appropriately insulated to minimize condensation on these components. This leaves the components so that they are relatively easily accessible.

In the event a more dedicated air flow path is desired, removable baffles (not shown) may be used to deflect the air flow around these heat pump circuit components. For access, the baffles are removed.

The full operation of the heat pump circuit 16 can best be understood by reference to application Ser. No. 827,733. In operation generally, it will be seen that the valves 70 and 71 can be arranged so that the high pressure refrigerant from compressor 61 flows through the source heat exchanger 64, operating as the condenser to cool the refrigerant, the expansion device 72 and then back to the suction side of the compressor 61 through the space heat exchanger 62 operating as the evaporator to heat the refrigerant. This is the "Space Cooling" mode. Reversing the refrigerant flow with reversing valve 70 reverses the flow of refrigerant so that the source heat exchanger 64 is the evaporator and space heat exchanger 62 is the condenser. In this configuration, the circuit is in the "Space Heating" mode.

If it is desirable to heat domestic hot water while the circuit 16 is in the "Space Cooling" mode, the three-way valve 71 is operated so that the refrigerant is circulated through the alternate heat exchanger 65 to act as the condenser rather than the source heat exchanger 64. This heats the hot water and cools the space. When it is desirable to heat hot water without effecting the conditioned space, the valves 70 and 71 are operated so that the high pressure refrigerant passes through the alternate heat exchanger 65 acting as the condenser and then through the source heat exchanger 64 acting as the evaporator back to the suction side of the compressor 61. This allows the heat to be extracted from the source heat exchanger 64 to heat hot water through the alternate heat exchanger 65. The source liquid pump 66 is operated when the source heat exchanger 64 is being used and the potable liquid pump 68 is operated while the alternate heat exchanger is being used.

What is claimed as invention is:

1. An integrated heat pump construction including:

a housing having opposed ends and defining an air passage therethrough along a passage axis, said air passage opening through both of said opposed ends of said housing;

a first air-to-refrigerant heat exchanger coil assembly mounted on said housing in said air passage intermediate the ends thereof to divide said air passage into first and second sections;

a blower assembly mounted on said housing within said first section of said air passage for positively forcing air in a first lengthwise direction through said air passage and through said first heat exchange coil;

a refrigerant compressor mounted on said housing within said second section of said air passage;

a second refrigerant-to-liquid heat exchange coil assembly mounted on said housing within said second section of said air passage; and a third refrigerant-to-potable liquid heat exchange coil assembly mounted on said housing within said second section of said air passage, said compressor and said first, second and third heat exchanger coil assemblies connected together to form a heat pump circuit with potable liquid heating capability, and said compressor and said second and third heat exchange coil assemblies arranged around the periphery of said second section of said air passage so that air can pass thereby as it flows along said air passage.

2. The heat pump construction of claim 1 further including:

first pump means mounted in said first section of said air passage for circulating liquid through said second heat exchange coil assembly; and second pump means mounted in said first section of said air passage for circulating potable liquid through said third heat exchange coil assembly.

3. The heat pump construction of claim 2 wherein said first heat exchange coil assembly includes a first air-to-refrigerant heat exchange coil and a coil mounting subframe, said coil mounting subframe mounted on said housing within said air passage and mounting said first heat exchange coil thereon, said subframe further including a mounting ledge thereon oriented generally perpendicular to said passage axis, said mounting ledge mounting said first and second pump means thereon.

4. The heat pump construction of claim 1 wherein said first heat exchange coil assembly is oriented at an acute angle with respect to the passage axis and defines a second tapered portion in said second section of said air passage; and wherein said third heat exchange coil assembly is oriented to project into said second tapered portion of said second section of said air passage.

5. The heat pump construction of claim 2 wherein said first heat exchange coil assembly is oriented at an acute angle with respect to the passage axis and defines a first tapered portion in said first section of said air passage; and wherein said first and second pump means are mounted in said first tapered portion of said first section of said air passage.

6. The heat pump construction of claim 5 wherein said first heat exchange coil assembly includes a mounting ledge in said first tapered portion of said first section of said air passage mounting said first and second pump means thereon so that said pump means communicate with said second section of said air passage through said mounting ledge.

7. The heat pump construction of claim 1 wherein said first heat exchange coil assembly includes a mounting ledge therein separating a portion of said first and second sections of said air passage; and further including first pump means mounted on said mounting ledge for circulating liquid through said second heat exchange coil assembly and second pump means mounted on said mounting ledge for circulating potable liquid through said third heat exchange coil assembly.

8. The heat pump construction of claim 1 wherein said housing includes an open framework including a top member, a bottom member, and a plurality of corner members joining said top and bottom members to form an open framework; and, a plurality of panels extending between said corner members and said top and bottom members to close said housing and define said air passage therethrough, said top member defining a first opening therethrough for air to pass out of said air passage and said bottom member defining a second opening therethrough for air to pass into said air passage.

9. The heat pump construction of claim 8 wherein said frame further includes component mounting means spaced above said bottom panel and defining openings therethrough through which air passing into said air passage through said second opening can pass, said component mounting means mounting said refrigerant compressor and said third heat exchange coil assembly thereon.

10. The heat pump construction of claim 9 further including secondary component mounting means mounted on said corner members and mounting said second heat exchange coil assembly thereon.

11. The heat pump construction of claim 1 further including insulation covering said compressor and said second and third heat exchange coil assemblies.

12. The heat pump construction of claim 3 wherein said first heat exchange coil is arranged at an acute angle with respect to the passage axis to define a first tapered portion in said first section of said air passage and to define a second tapered portion in said second section of said air passage.

13. The heat pump construction of claim 12 wherein said third heat exchange coil assembly includes at least one elongate double wound coil having a length such that said coil projects into said second tapered portion of said second section of said air passage.

14. The heat pump construction of claim 13 wherein said housing includes an open framework including a top member, a bottom member, and a plurality of corner members joining said top and bottom members to form an open framework; and, a plurality of panels extending between said corner members and said top and bottom members to close said housing and define said air passage therethrough, said top member defining a first opening therethrough for air to pass out of said air passage and said bottom member defining a second opening therethrough for air to pass into said air passage.

15. The heat pump construction of claim 14 wherein said frame further includes component mounting means spaced above said bottom panel and defining openings therethrough through which air passing into said air passage through said second opening can pass, said component mounting means mounting said refrigerant compressor and said third heat exchange coil assembly thereon; secondary component mounting means mounted on said corner members and mounting said second heat exchange coil assembly thereon; and insulation covering said compressor and said second and third heat exchange coil assemblies.

16. An integrated heat pump construction including:

a housing having opposed ends and defining an air passage therethrough along a passage axis, said air passage opening through both of said opposed ends of said housing; said housing including an open framework including a top member, a bottom member, and a plurality of corner members joining said top and bottom members to form an open framework; a plurality of panels extending between said corner members and said top and bottom members to close said housing and define said air passage therethrough, said top member defining a first opening therethrough for air to pass out of said air passage and said bottom member defining a second opening therethrough for air to air into said air passage; and component mounting means spaced above said bottom panel and defining openings therethrough through which air passing into said air passage through said second opening can pass;

a first air-to-refrigerant heat exchanger coil assembly mounted on said housing in said air passage intermediate the ends thereof to divide said air passage into first and second sections;

a blower assembly mounted on said housing within said first section of said air passage for positively forcing air in a first lengthwise direction through said air passage and through said first heat exchange coil;

a refrigerant compressor mounted on said component mounting means within said second section of said air passage; and a second refrigerant-to-liquid heat exchange coil assembly mounted on said housing within said second section of said air passage, said compressor and said first and second heat exchanger coil assemblies connected together to form a heat pump circuit, and said compressor and said second heat exchange coil assembly arranged around the periphery of said second section of said air passage so that air can pass thereby as it flows along said air passage.

17. The heat pump construction of claim 16 wherein said housing includes a removable baffle arrangement in said air passage about said compressor and said second heat exchanger to define a dedicated air flow path past these components.

* * * * *